US010925119B2

(12) United States Patent
Sajic et al.

(10) Patent No.: US 10,925,119 B2
(45) Date of Patent: Feb. 16, 2021

(54) FABRIC HEATING ELEMENT

(71) Applicant: LAMINAHEAT HOLDING LTD., Leixlip (IE)

(72) Inventors: Peter Sajic, Broadstone (GB); Vincent Moulin, Ansouis (FR)

(73) Assignee: Laminaheat Holding Ltd., Kildare (IE)

( * ) Notice: Subject to any disclaimer, the term of this patent is extended or adjusted under 35 U.S.C. 154(b) by 463 days.

(21) Appl. No.: 15/542,884

(22) PCT Filed: Jan. 12, 2016

(86) PCT No.: PCT/IB2016/000095

§ 371 (c)(1),
(2) Date: Jul. 11, 2017

(87) PCT Pub. No.: WO2016/113633

PCT Pub. Date: Jul. 21, 2016

(65) Prior Publication Data

US 2018/0279416 A1 Sep. 27, 2018

Related U.S. Application Data

(60) Provisional application No. 62/102,169, filed on Jan. 12, 2015.

(51) Int. Cl.
*H05B 1/02* (2006.01)
*H05B 3/14* (2006.01)
(Continued)

(52) U.S. Cl.
CPC ..... *H05B 1/0272* (2013.01); *H05B 1/0238* (2013.01); *H05B 3/03* (2013.01);
(Continued)

(58) Field of Classification Search
CPC ..... H05B 3/0004; H05B 3/342; H05B 3/305; H05B 3/146; H05B 3/36; H05B 3/145;
(Continued)

(56) References Cited

U.S. PATENT DOCUMENTS 2,557,983 A 6/1951 Linder
3,774,299 A 11/1973 Sato et al.
(Continued)

FOREIGN PATENT DOCUMENTS

CN 104159341 B 12/2015
DE 1615494 A1 2/1971
(Continued)

OTHER PUBLICATIONS

International Preliminary Report on Patentability for International Application No. PCT/IB2015/000095, dated Jan. 12, 2016—9 Pages.
(Continued)

*Primary Examiner* — Shawntina T Fuqua
(74) *Attorney, Agent, or Firm* — RatnerPrestia

(57) ABSTRACT

A fabric heating element including an electrically conductive, non-woven fiber layer having a plurality of conductive fibers collectively having an average length of less than 12 mm. The fabric heating element also including at least two conductive strips electrically connected to the fiber layer over a predetermined length, positioned adjacent opposite ends of the fiber layer, and configured to be electrically connected to a power source.

43 Claims, 9 Drawing Sheets

(51) Int. Cl.
*H05B 3/34* (2006.01)
*H05B 3/03* (2006.01)

(52) U.S. Cl.
CPC ..... *H05B 3/145* (2013.01); *H05B 3/342* (2013.01); *H05B 2203/005* (2013.01); *H05B 2203/011* (2013.01); *H05B 2203/026* (2013.01); *H05B 2203/029* (2013.01); *H05B 2203/036* (2013.01)

(58) Field of Classification Search
CPC ..... H05B 3/03; H05B 2203/029; H05B 2203/005; H05B 2203/011; H05B 2203/013; H05B 2203/014; H05B 2203/017; H05B 2203/021; H05B 2203/033; H05B 2203/026; H05B 2203/036; H05B 1/0272; H05B 1/0238; B23P 11/00; H01C 17/0652
See application file for complete search history.

(56) References Cited

U.S. PATENT DOCUMENTS 4,007,083 A 2/1977 Ring
4,049,491 A 9/1977 Brandon et al.
4,200,488 A 4/1980 Brandon et al.
4,534,886 A * 8/1985 Kraus ..... B29C 70/504 252/502
4,719,335 A 1/1988 Batliwalla et al.
4,725,717 A 2/1988 Harrison
4,728,395 A 3/1988 Boyd
4,737,618 A 4/1988 Barbier et al.
4,931,627 A 6/1990 Watts
4,960,979 A 10/1990 Nishimura
5,403,993 A 4/1995 Cordia et al.
5,582,757 A 12/1996 Kio et al.
5,900,295 A 5/1999 Kawada
5,925,275 A 7/1999 Lawson et al.
5,932,124 A 8/1999 Miller et al.
5,942,140 A 8/1999 Miller et al.
5,954,977 A 9/1999 Miller et al.
5,981,911 A 11/1999 Miller et al.
6,015,965 A 1/2000 Miller et al.
6,037,572 A 3/2000 Coates et al.
6,087,630 A 7/2000 Miller et al.
6,108,581 A 8/2000 Jung
6,124,571 A 9/2000 Miller et al.
6,145,787 A 11/2000 Rolls
6,184,496 B1 2/2001 Pearce
6,294,758 B1 9/2001 Masao et al.
6,483,087 B2 11/2002 Gardner et al.
6,593,555 B2 7/2003 Hayashi
6,710,313 B1 3/2004 Asami et al.
6,727,471 B2 4/2004 Evans et al.
6,737,611 B2 5/2004 Ek et al.
6,741,805 B2 5/2004 Wu
6,870,139 B2 3/2005 Petrenko
6,949,727 B2 9/2005 Parks
7,034,257 B2 4/2006 Petrenko
7,067,776 B2 7/2006 Michelmann
7,105,782 B2 9/2006 Yue
7,173,223 B2 2/2007 Kuo et al.
7,247,822 B2 7/2007 Johnston
7,268,325 B1 9/2007 Chuang
7,372,006 B2 5/2008 Aisenbrey
7,439,475 B2 10/2008 Ohta
7,570,760 B1 8/2009 Olson et al.
7,629,558 B2 12/2009 Petrenko
7,638,735 B2 12/2009 Petrenko
7,678,614 B2 3/2010 Huang et al.
7,703,300 B2 4/2010 Petrenko
7,781,706 B2 8/2010 Park
7,820,945 B2 10/2010 Seo
7,827,675 B2 11/2010 Pan et al.
7,838,804 B2 11/2010 Krobok
7,884,307 B2 2/2011 Li et al.
8,076,613 B2 12/2011 Raidt et al.
8,197,621 B2 6/2012 Jung
8,308,889 B2 11/2012 Glancy et al.
8,334,226 B2 12/2012 Nhan et al.
8,357,881 B2 1/2013 Feng et al.
8,405,002 B2 3/2013 Petrenko
8,519,305 B2 8/2013 Nakajima et al.
8,544,942 B2 10/2013 Lazanja et al.
8,674,265 B2 3/2014 Bode
8,702,164 B2 4/2014 Lazanja et al.
8,723,043 B2 5/2014 Weiss et al.
8,752,279 B2 6/2014 Brittingham et al.
8,866,052 B2 10/2014 Nhan et al.
8,921,739 B2 12/2014 Petrenko et al.
8,931,751 B2 1/2015 Funke et al.
9,020,333 B2 4/2015 Bigex et al.
9,046,207 B2 6/2015 Bigex et al.
9,161,392 B2 10/2015 Anbe
9,185,748 B2 11/2015 Zimmerer et al.
9,241,373 B2 1/2016 Schaeffer et al.
9,269,560 B2 2/2016 Klumpp et al.
9,271,334 B2 2/2016 Fu
9,290,890 B2 3/2016 Naylor
9,945,080 B2 4/2018 Caterina et al.
2002/0153368 A1 10/2002 Gardner et al.
2003/0155347 A1 8/2003 Oh et al.
2004/0035853 A1 2/2004 Pais
2004/0055699 A1 3/2004 Smith et al.
2004/0056020 A1 3/2004 Helmreich et al.
2005/0167412 A1 8/2005 Anson et al.
2005/0184053 A1 8/2005 Wilkinson et al.
2005/0205551 A1 9/2005 Aisenbrey
2006/0278631 A1 12/2006 Lee et al.
2006/0289468 A1 12/2006 Seibert et al.
2007/0056946 A1 3/2007 Chen
2008/0156786 A1 7/2008 Choi
2008/0166563 A1 7/2008 Brittingham et al.
2008/0179448 A1* 7/2008 Layland ..... H05B 3/28 244/1 N
2008/0196429 A1 8/2008 Petrenko et al.
2008/0210679 A1 9/2008 Raidt et al.
2008/0223842 A1 9/2008 Petrenko et al.
2008/0272106 A1 11/2008 Naylor
2009/0041996 A1 2/2009 Boissy
2009/0127250 A1 5/2009 Chang
2009/0152257 A1 6/2009 Cheng
2009/0169826 A1 7/2009 Kuerschner
2009/0218854 A1 9/2009 Pfahler
2009/0235681 A1 9/2009 Petfenko et al.
2009/0289046 A1 11/2009 Richmond
2009/0294435 A1 12/2009 Nhan et al.
2010/0038356 A1 2/2010 Fukuda et al.
2010/0038357 A1 2/2010 Fukuda et al.
2010/0059503 A1 3/2010 Petrenko
2010/0084389 A1 4/2010 Petrenko
2010/0176118 A1 7/2010 Lee et al.
2010/0200558 A1 8/2010 Liu et al.
2010/0279177 A1 11/2010 Yang
2010/0282458 A1 11/2010 Ann et al.
2010/0282736 A1 11/2010 Koch et al.
2011/0036828 A1 2/2011 Feng et al.
2011/0036829 A1 2/2011 Fugetsu et al.
2011/0041246 A1 2/2011 Li et al.
2011/0046703 A1 2/2011 Chen
2011/0068098 A1 3/2011 Li
2011/0084054 A1 4/2011 Bahr
2011/0096902 A1 4/2011 Anbe
2011/0232888 A1 9/2011 Sasaki
2012/0168430 A1 7/2012 Seo
2013/0001212 A1 1/2013 Mangoubi
2013/0020314 A1 1/2013 Hashimoto et al.
2013/0064528 A1 3/2013 Bigex et al.
2013/0168382 A1 7/2013 Teramoto et al.
2013/0186884 A1* 7/2013 Barfuss ..... H05B 3/342 219/529
2013/0228562 A1 9/2013 Chen
2013/0233476 A1 9/2013 Glancy et al.
2013/0277359 A1 10/2013 Fukuda et al.

(56) References Cited

U.S. PATENT DOCUMENTS

| | | | |
|---|---|---|---|
| 2013/0319997 | A1 | 12/2013 | Chao |
| 2014/0001170 | A1 | 1/2014 | Son et al. |
| 2014/0151353 | A1 | 6/2014 | Steinwandel et al. |
| 2014/0187140 | A1 | 7/2014 | Lazanja et al. |
| 2014/0231404 | A1 | 8/2014 | Struck |
| 2014/0312027 | A1 | 10/2014 | Augustine et al. |
| 2014/0316494 | A1 | 10/2014 | Augustine et al. |
| 2014/0316495 | A1 | 10/2014 | Augustine et al. |
| 2015/0021315 | A1 | 1/2015 | Blanke |
| 2015/0024168 | A1 | 1/2015 | Son |
| 2015/0163856 | A1 | 6/2015 | Jeon et al. |
| 2015/0245729 | A1 | 9/2015 | Morin et al. |
| 2015/0267359 | A1 | 9/2015 | Berger |
| 2015/0373782 | A1 | 12/2015 | Kang et al. |
| 2016/0021704 | A1 | 1/2016 | Elverud |
| 2016/0021945 | A1 | 1/2016 | Richmond |
| 2016/0059670 | A1 | 3/2016 | Satzger et al. |
| 2016/0060871 | A1 | 3/2016 | Kulkarni et al. |
| 2016/0089863 | A1 | 3/2016 | Fetfatsidis et al. |
| 2018/0288830 | A1 | 10/2018 | Sajic |

FOREIGN PATENT DOCUMENTS

| | | | |
|---|---|---|---|
| DE | 4321474 | A1 | 1/1995 |
| EP | 0188160 | A1 | 7/1986 |
| EP | 0278139 | A1 | 2/1987 |
| EP | 0719074 | A2 | 6/1996 |
| EP | 0732038 | A1 | 9/1996 |
| EP | 0808640 | A2 | 11/1997 |
| EP | 0894065 | A1 | 2/1999 |
| EP | 0926925 | A1 | 6/1999 |
| EP | 0963138 | A2 | 12/1999 |
| EP | 0979023 | A1 | 2/2000 |
| EP | 0894417 | B1 | 12/2000 |
| EP | 1132028 | A1 | 9/2001 |
| EP | 0894225 | B1 | 12/2001 |
| EP | 1298961 | A2 | 4/2003 |
| EP | 0959749 | B1 | 7/2003 |
| EP | 098437 | B1 | 10/2003 |
| EP | 1438727 | A1 | 7/2004 |
| EP | 1467598 | A2 | 10/2004 |
| EP | 1483939 | A1 | 12/2004 |
| EP | 1515094 | A2 | 3/2005 |
| EP | 1525281 | A1 | 4/2005 |
| EP | 1601235 | A2 | 11/2005 |
| EP | 1602302 | A2 | 12/2005 |
| EP | 1652454 | A2 | 5/2006 |
| EP | 1689575 | A1 | 8/2006 |
| EP | 1796432 | A1 | 6/2007 |
| EP | 1844526 | A1 | 10/2007 |
| EP | 1864552 | A2 | 12/2007 |
| EP | 1865553 | A2 | 12/2007 |
| EP | 1897411 | A1 | 3/2008 |
| EP | 1900254 | A1 | 3/2008 |
| EP | 1325665 | B1 | 4/2009 |
| EP | 2099596 | A2 | 9/2009 |
| EP | 2109343 | A2 | 10/2009 |
| EP | 2123120 | A2 | 11/2009 |
| EP | 2127473 | A2 | 12/2009 |
| EP | 2023688 | B1 | 3/2010 |
| EP | 2200396 | A1 | 6/2010 |
| EP | 1956303 | B1 | 7/2010 |
| EP | 2249617 | A1 | 11/2010 |
| EP | 2293050 | A1 | 3/2011 |
| EP | 2329682 | a2 | 6/2011 |
| EP | 2422949 | A1 | 2/2012 |
| EP | 2430878 | A1 | 3/2012 |
| EP | 2461643 | A1 | 6/2012 |
| EP | 2548717 | A2 | 1/2013 |
| EP | 2558761 | a1 | 2/2013 |
| EP | 2559318 | A1 | 2/2013 |
| EP | 2551894 | A1 | 3/2013 |
| EP | 2606630 | A1 | 6/2013 |
| EP | 2656685 | A1 | 10/2013 |
| EP | 2689194 | A2 | 1/2014 |
| EP | 2160072 | B1 | 5/2014 |
| EP | 2558274 | B1 | 8/2014 |
| EP | 2827069 | A2 | 1/2015 |
| EP | 2900035 | A1 | 7/2015 |
| EP | 2955975 | A1 | 12/2015 |
| EP | 2493678 | B1 | 3/2016 |
| EP | 2283177 | B1 | 4/2016 |
| GB | 2493001 | a | 7/2011 |
| WO | 2006103081 | A1 | 10/2006 |

OTHER PUBLICATIONS

International Search Report and Written Opinion for International Application No. PCT/IB2016/000095, dated May 12, 2016—11 Pages.

LaminaHeat: PowerFilm, www.laminaheat.com, Dec. 2014—2 Pages.

Chemitex Data Sheet, www.chmcomposites.com—1 Page.

"How Do Heated Panels Work," 4 pages, downloaded from Internet, Jul. 15, 2019, https://www.compositeadvantage.com/blog/how-do-heated-panels-work.

Chinese Office Action for Application No. 201680009737.7, dated Jan. 21, 2020 with translation, 15 pages.

Canadian Office Action for Canadian Application No. 2,973,557, dated Dec. 17, 2019, 4 pages.

Communication under Rule 71(3) EPC for EP Application No. 16 709 103.2, dated Dec. 9, 2019, 7 pages.

Notice of Allowance for U.S. Appl No. 15/928,952, dated Aug. 27, 2020, 38 pages.

Extended European Search Report for European Application No. 20101190.2, dated Jul. 2, 2020, 12 pages.

* cited by examiner

FABRIC HEATING ELEMENT

CROSS REFERENCE TO RELATED APPLICATIONS

This application is the U.S. National Phase Application of PCT/IB2016/000095 filed Jan. 12, 2016, which claims priority to U.S. Provisional Application No. 62/102,169, filed Jan. 12, 2015. The contents of the foregoing applications are incorporated by reference herein.

FIELD

The present invention relates to a fabric heating element and a method for manufacturing the fabric heating element.

SUMMARY

One embodiment comprises a fabric heating element including an electrically conductive, non-woven fiber layer having a plurality of conductive fibers collectively having an average length of less than 12 mm. The fabric heating element also includes at least two conductive strips electrically connected to the fiber layer over a predetermined length, positioned adjacent opposite ends of the fiber layer, and configured to be electrically connected to a power source.

In one embodiment, the fabric heating element also comprises a first adhesive layer adhered to a first side of the fiber layer and a first insulating layer, and a second adhesive layer adhered to a second side of the fiber layer and a second insulating layer.

In one embodiment a controller is electrically connected to the power supply and the at least two conductive strips. The controller is configured to apply a voltage from the power supply to the at least two conductive strips.

In one embodiment, the fiber layer has a uniform electrical resistance in any direction. In one embodiment, the fiber layer consists of the plurality of conductive carbon fibers, the binder, optionally one or more fire retardants, and optionally a plurality of non-conductive fibers. In one embodiment, each of the conductive fibers has a length in the range of 6-12 mm. In one embodiment, the fiber layer consists essentially of individual unentangled fibers.

BACKGROUND

Heating elements capable of generating and sustaining moderate uniform temperatures over small and large areas are desirable for a variety of applications, ranging from under-floor heating to far infrared (FAR) heating panels for buildings to car seating, electric blankets and clothing for consumer use.

Historically, such applications have used resistive wire wound in a winding pattern that covers the area to be heated. In some applications, large amounts (e.g. 50 meters) of wire may be used just to cover a single square meter of heated area. Loops of resistive wire generally cannot provide desirable uniform temperatures. Wires which are sufficiently fine and closely spaced to provide the required temperatures without "hot spots" are often fragile and easily damaged, with the attendant dangers of fire and electrical shock. Also, resistive wires tend to be very thin so that they don't affect the material they are embedded in, as otherwise they may become a flaw or inclusion, which creates structural problems in the heater material after a short period of time.

Metal sheet and foils are generally suitable only for a limited range of applications in which corrosion resistance is not required, and cost is no object. Generally, such materials cannot feasibly be embedded as an internal heater element.

Because of the shortcomings of traditional metal wires and sheets, a great deal of effort has been devoted to developing woven and non-woven carbon fiber webs for use as heating elements. Short carbon fibers (e.g. fibers of 5 to 20 microns in diameter and between approximately 3 and 9 mm in average fiber length) are typically used to achieve a uniform sheet with the desired uniform heat dispersion properties. Average fiber lengths exceeding 9 mm may cause technical difficulties manufacturing with uniformly dispersed carbon fiber throughout, such that irregularity in the resistance value from point to point in the sheet may become problematic.

There are a number of disadvantages, however, in making non-woven conductive webs with short carbon fibers. For example, conductivity varies roughly as the square of fiber length in a non-woven. Consequently, obtaining a given conductivity typically calls for a relatively high percentage of shorter fibers. Certain desirable mechanical properties, such as web tensile and tear strength and flexibility, also improve significantly with increased average fiber length. Loading the web with large quantities of short carbon fiber makes it difficult to produce acceptable physical/mechanical properties in webs made on commercial machines.

Also, in order to capitalise on the range of electrical properties available in a non-woven web, the aerial weight may vary between 8 to 60 gsm. At aerial weights below 20 gsm, non-woven webs can be difficult to handle or are fragile and prone to damage when used in commercial applications as heating elements.

DETAILED DESCRIPTION

Provided is a fabric heating element that can be embedded in materials in need of heat (e.g. vehicle seat, clothing, etc.), and that is compatible with the material to be heated, thus providing heat from the inside, which is more efficient and faster than providing heat from the outside of the material.

In one example, the device includes a non-metallic porous or perforated fabric heating element comprising an electrically-conductive inner non-continuous fibrous web layer with integrated conductive busbar strips. The inner layer is bonded and sandwiched between two outer insulating layers of woven or non-woven material, (e.g. continuous fiber) material. The fabric heating element is configured for use as a heated fabric or to be embedded in laminated or solid materials. In some embodiments, such as those in which the inner layer is perforated, the resulting construction may comprise adhesive extending between the inner and outer layers as well as through the perforations in the inner layer. Applications of the device include any item containing such a fabric heating element, such as, for example, apparel or other textiles, and laminated or solid materials.

An exemplary process for manufacturing the fabric heating element, comprising adhesively bonding an electrically-conductive inner non-continuous fibrous web layer between outer insulating layers of woven or non-woven material is described herein. The step of bonding the conductive busbar strips to the inner layer may be performed simultaneously with the step of bonding the inner and outer layers together, or prior to the inner/outer layer bonding step. In an embodiment in which the inner layer is perforated, the step of bonding the inner layer to the outer layers may comprise the adhesive used for bonding between the layers extending into the perforations in the inner layer.

An application may comprise a process for embedding the fabric heating element as described herein into a composite structure, the process comprising forming the multi-ply fabric heating element as described herein, and then bonding the fabric heating element into the composite structure. Some embodiments may comprise, prior to the embedding step, perforating the fabric heating element, in which case the embedding step may comprise material from the composite structure penetrating the perforations in the fabric heating element.

The inner electrically conductive layer typically includes fine conductive fibers, typically carbon, dispersed homogeneously in the inner heater element to form a dense network, which convert electricity into heat by the act of resistive heating. By applying a voltage across the conductive (e.g. metallic copper) strips, the resistance of the electrically conductive layer causes a uniform current density, which in turn produces the uniform heating.

Figure 1:
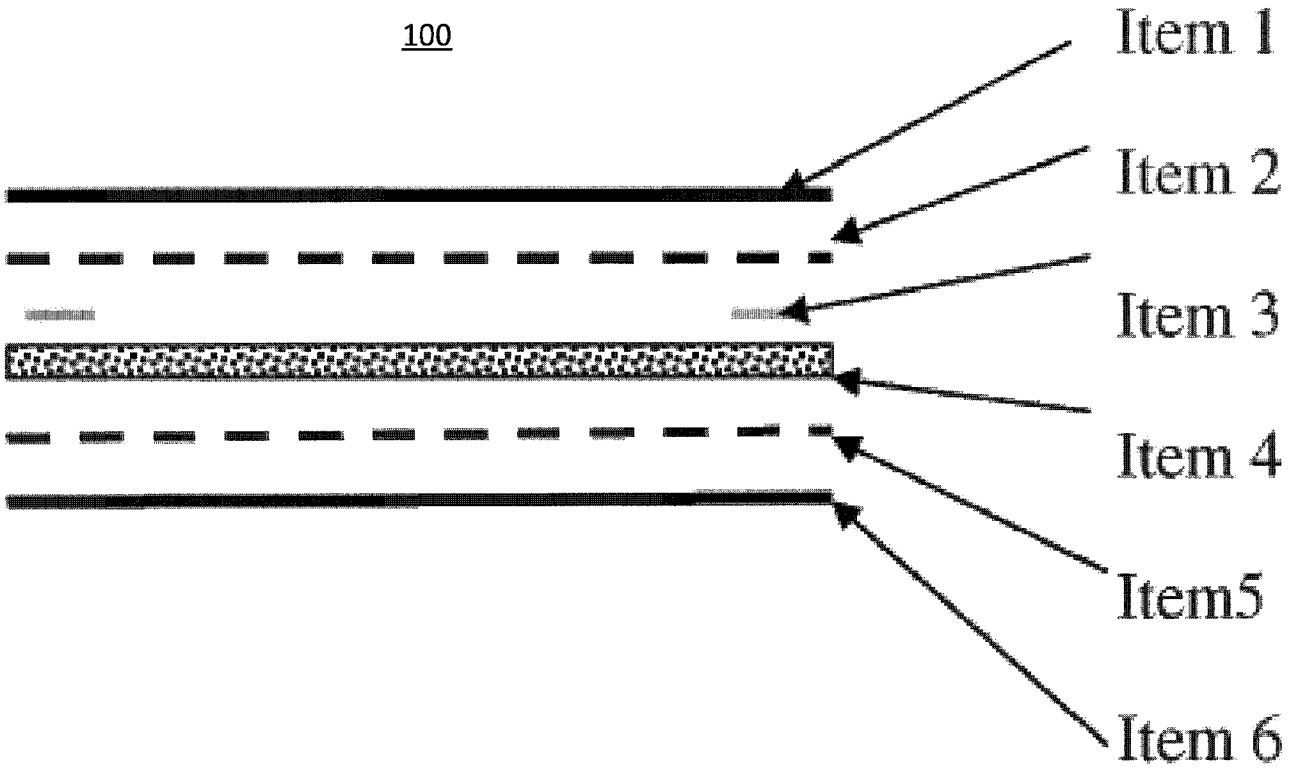
FIG. 1 is a cross sectional view of the fabric heating element construction, according to an embodiment of the present invention.

In one example, the fabric heating element 100 shown in FIG. 1 includes six layers of material that form a hybrid construction of busbars and fabric. These layers are shown in the cross-sectional view of FIG. 1 as Item 1, Item 2, Item 3, Item 4, Item 5 and Item 6. Items 1 and 6 are outer insulating and reinforced layers (e.g. woven glass fabric such as aerial weight in the range of 20-100 gsm). Items 2 and 5 are adhesive layers (e.g. thermoplastic Polyethylene terephthalate (PET) web having aerial weight of 15 gsm). Item 4 is an inner electrically conductive non-woven fiber layer (e.g. carbon fiber having aerial weight of 8-60 gsm). Item 3 refers to metallic (e.g. copper) strips having specific dimensions (e.g. 19 mm wide and 50 microns thick), which act as busbars.

In general, the outer layers comprise an insulating woven or nonwoven fabric (e.g. Items 1 and 6), typically made from a continuous filament. The term "continuous filament" or "continuous fiber" when used to characterize yarns, fabrics, or composites may not actually be "continuous" in the strictest definition of the word, and in actuality such fibers or filaments vary from as short as several feet in length to several thousand feet in length. Everything in this wide range is generally called "continuous" because the length of the fibers tends to be orders of magnitude larger than the width or thickness of the raw composite material.

The inner heating element layer (e.g. Item 4), sandwiched between the outer layers (e.g. Items 1 and 6), includes an electrically conductive material, such as a discontinuous non-woven carbon or carbon/glass fiber web as described herein. Bonded to the inner electrically conductive layer (e.g. Item 4) are two conductive (e.g. metallic copper) strips (e.g. Item 3) that act as electrical busbars. The copper strips ensure uniform current flow throughout the electrical conductive non-woven web, and hence uniform heating due to the resistance. These conductive strips also facilitate connection of power cables to the heater. Although often referred to herein as "copper" strips, it should be understood that the strips are not limited to any particular conductive materials.

The outer layers (e.g. Items 1 and 6) are bonded to the electrically conductive inner layer (e.g. Item 4) using a thermoplastic or thermoset web (e.g. Items 2 and 5) disposed between the inner and outer layers, which results in a hybrid construction heater material.

With reference to FIG. 1, exemplary heater elements may be constructed as follows, without limitation to the exemplary material types and features listed:

Items 1 and 6 (Outer insulating and reinforcing layers):

Material may comprise, for example, a glass fiber woven fabric using E-type fibers. Specific examples include but are not limited to Type 30® Single end roving fabric (Owen Corning Inc.) and Flexstrand® 450 Single End roving fabric (FGI Inc.). Exemplary features or characteristics may include:

Weave: US style 117 Plain
Warp Count: 54
Fill Count: 3
Warp yarn: ECD* 4501/2
Fill Yarn: ECD 4501/2
Weight: 83 g/m2
Thickness: 0.09 mm
Tensile Strength: 163 lbf/in (28.6 N/mm)

*"ECD 4501/2" as a yarn type refers to:

E=Eglass fiber type
C=Continuous fiber
D=fiber dia 0.00023"
450=tex or weight of strand (×100 yd/lb), 2000 filaments/strand
1/2=2 strands twisted together to form one yarn An example of such an ECD 4501/2 yarn includes Hexcel Corp 117 Style.

Items 2 and 5: Adhesive film (between outer layers and heating film). Material may comprise a thermoplastic, such as a modified PET web, with the following exemplary features or characteristics:

Melt temperature: 130 deg C.
Peel strength to steel: 150-300 N/75 mm
Lap shear strength: 5-10 Mpa Item 3: Conductive Strips. Material may comprise copper, having the following exemplary features or characteristics:

Copper thickness: 0.05 mm
Adhesive thickness (between strip and heating film): 0.02 mm
Strip thickness: 0.075 mm
Peel strength to steel (of adhesive): 4.5 N/cm
Tensile strength: 85 N/cm Temp resistance: 160 deg C.

Electrical thru thickness resistance: 0.003 ohms

Item 4: Non-Woven carbon fiber heating film. Exemplary features or characteristics may include:

Fiber type: High Strength Polyacrylonitrile (PAN)

Filament: 12K

Fiber length: 6 mm

Arial weight: 20 gsm

Surface Electrical resistance: 4 ohms/square

Tensile Strength: 36 N/15 mm

The non-woven electrically conductive sheet may be formed by wet-laid manufacturing methods from conductive fibers (preferably carbon), non-conductive fibers (glass, aramid, etc. to control overall resistance), one or more binder polymers, and optional flame retardants. Preferred lengths for the fibers (both conductive and non-conductive) are in the range of 6-12 mm in length. Exemplary binder polymers may include: Poly vinyl alcohol, Co-polyester, Cross linked polyester, Acrylic and Polyurethane. Exemplary flame retardant binders may include Polyimide and Epoxy. Suitable wet-laying techniques may comprise a state of the art continuous manufacturing process.

The amount of conductive fiber required depends upon the type of conductive fiber chosen, the voltage and power at which the heating element is to be used, and the physical size/configuration of the heating element, which will determine the current path and density throughout it. Lower voltages and longer current paths require relatively more conductive fiber and lower electrical resistance. Ideal sheets have uniform electrical resistance in any direction. For example, the electrical resistance in the a first direction (e.g. the machine direction) is substantially equal (+/−5%) to the electrical resistance in a second direction perpendicular to the first direction (e.g. the cross-machine direction).

An exemplary electrically conductive carbon fiber sheet known in the art is a Chemitex 20 carbon fiber veil (CHM Composites, Ltd.). Chemitex 20 is a PAN based carbon fiber veil having an areal base weight of 17 g/m2, a styrene soluble binder, a thickness of 0.15 mm, a tensile strength in the machine direction and in the cross-machine direction of 60 N/15 mm, and a resistivity of 5 ohms per square. However, standard commercial carbon fiber sheets (e.g. Chemitex carbon fiber sheets) have been found to be less than ideal for implementing preferred heating element embodiments for various reasons (e.g. fragility of the fiber sheet, non-uniformity of electrical resistance in different directions along the sheet, longer length of fibers in the sheet). It has also been found that conductive sheets having the characteristics discussed herein avoid the additional cost and burden required to add metallic particles to the sheet, as discussed in, for example, U.S. Pat. No. 4,534,886 to Kraus.

In one embodiment, all or a portion of the conductive and/or non-conductive fibers in the non-woven electrically conductive sheet are less than or equal to 12 mm in length, such that the average fiber length is less than or equal to 12 mm. The wet-laid manufacturing method used to manufacture the non-woven electrically conductive sheet does not require additional conductive material (e.g. conductive particles) to attain uniform electrical resistance. In another embodiment, all of the conductive and/or non-conductive fibers in the non-woven electrically conductive sheet are in the range of 6 mm to 12 mm in length, with no other additional conductive particles present.

Conductive fibers which have electrical resistances of 25,000 ohm/cm or lower, in the range of 25 to 15,000 ohm/cm, and which have melting points higher than about 500° C. are beneficial. Conductive fibers which are non-flammable, and are not brittle are also beneficial. It is also beneficial that neither their resistances nor their mechanical properties are significantly affected by temperature variations in the range of 0°-500° C. Other factors such as relatively low water absorption, allergenic properties, and adhesive compatibility may also enter into the selection processes. Suitable fibers include carbon, nickel-coated carbon, silver-coated nylon, and aluminised glass.

Carbon fibers are beneficial for use in heating elements for consumer applications such as under floor heating mats, since they have all the desired characteristics, are relatively inexpensive, and can be used in small but manageable concentrations to provide the desired heat output at standard household voltages. Heating elements for use at low voltages may also be produced. 25 volts, for example, is generally considered to be the maximum shock-proof voltage. In order to protect their patients, most hospitals and nursing homes require that their heating mats operate at this voltage. There are a number of potential applications for battery-powered heating elements, but these elements may operate at 12 volts or less. There has been a long-felt need for a heating element which could maintain temperatures in the range of 50°-180° C. at these voltages. Low-voltage heating elements can be manufactured by increasing the concentration of conductive fibers in the element or by using specific types of conductive fibers. For example, because of their high conductivity, metal-coated fibers such as nickel-coated carbon are suitable alternatives to carbon fibers for these applications, but carbon fibers and carbon fiber/metal-coated fiber mixtures have also been used successfully.

Figure 8A:
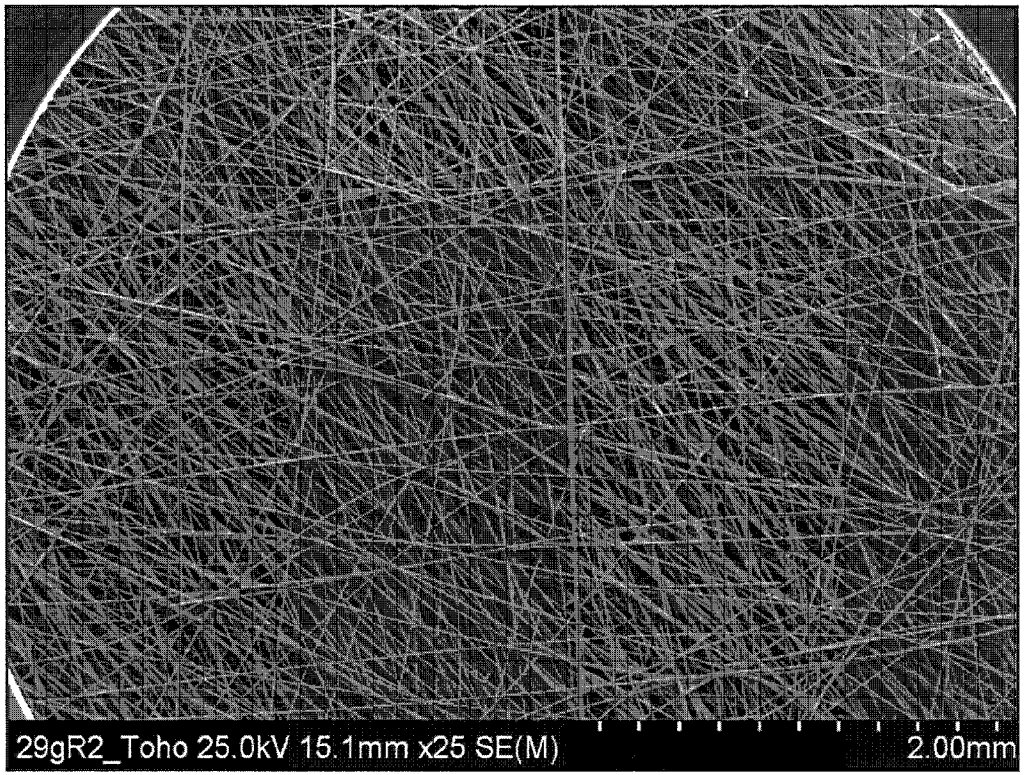
FIG. 8A is an image showing a magnification of a portion of an exemplary non-woven conductive fiber sheet fabric suitable for use in embodiments of the present invention.
Figure 8B:
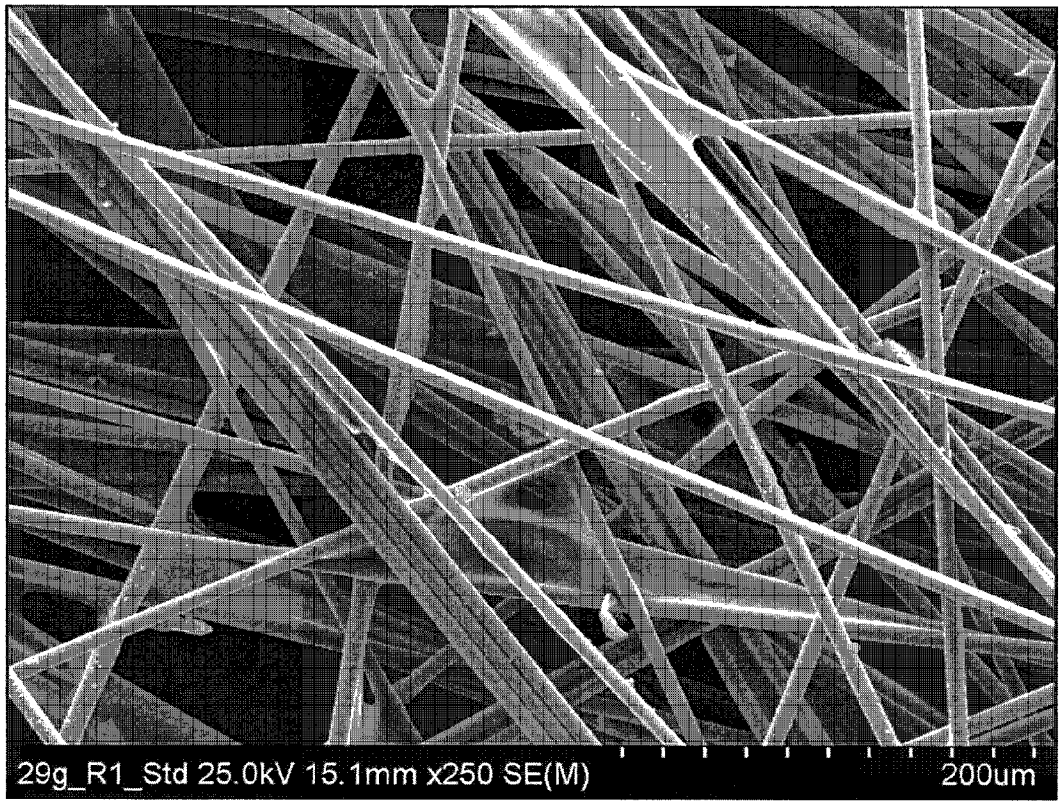
FIG. 8B is an image showing a magnification (greater magnification than FIG. 8A) of a portion of an exemplary non-woven conductive fiber sheet fabric suitable for use in embodiments of the present invention.

Referring now to FIGS. 8A and 8B, there are shown two magnified photographs (FIG. 8B has greater magnification than FIG. 8A) of a representative portion of an exemplary non-woven fiber sheet that is particularly well-suited for use in connection with the claimed invention. As can be seen in these photographs, the fiber sheet comprises a plurality of individual, substantial straight unentangled fibers, all of which are fall within a specified range of lengths (e.g. 6-12 mm). A sheet consisting of only individual, unentangled fibers (i.e. each fiber is "unentangled" with any other fiber) throughout the entire sheet is void of defects that can otherwise cause operational issues when the sheet is used practice as described herein. Such defects (not shown) to be avoided may include but are not limited to "logs or sticks" (i.e. bundles of fibers whose ends are aligned and thus act as if they are outside the specified range); "ropes" (i.e. fiber assemblages with unaligned ends that are not completely isolated from one another or that are entwined around one another along the axes of the fibers); "fused fibers" (i.e. bundles of fibers fused at the ends or along the fiber length); or "clumps" or "dumbbells" (i.e. assemblages of normal-length fibers ensnared by one or more overly long fibers).

While each individual fiber of the non-woven sheet is desirably in contact with one or more other individual fibers as part of the non-woven structure of the sheet, ideal contact differs from entanglement in that entanglement typically involves two or more fibers wound around each other along the longitudinal axis of the fibers, whereas preferred contact comprises straight, unentangled fibers having multiple points of contact with other straight unentangled fibers such that the longitudinal axes of the contacting fibers are at acute or perpendicular angles with one another. To ensure high quality performance, some embodiments may comprise sheets that have been visually checked (manually or with machine vision) to confirm the absence of defects such as but not limited to those described above, and only sheets consisting essentially of individual, unentangled fibers (i.e.

sheets having a defect rate of less than 200 per 100 gram weight of material) may be used. Manufacturing processes for making sheets for use as described herein are therefore preferably designed to provide first quality as a high percentage of throughput.

Polyacrylonitrile (PAN) is an acrylic precursor fiber used for manufacturing carbon fiber. Other precursors, such as rayon or pitch base may be used, but PAN is a beneficial choice for performance, consistency and quality for this application. Beneficial heater element material characteristics may include:

Electrical resistance between 1-200 ohm/sq

Applied voltages across the copper strips: 0-120 VDC and 0-240 vAC

Single phase 50 Hz and 415 vAC 3-phase 50 HZg,

Typical maximum temperature: 400 deg C.

Typical temperature uniformity: +/−2 deg C.

Heat-up rates: up to 30 deg C./min

Heater element materials that are flexible and can easily be draped or formed into 3D shapes are particularly advantageous. Use of a veil heater element that is not coated or treated, in combination with the other exemplary layers described herein, results in a fabric that includes an uncoated or dry perform that may be infused or impregnated with the material into which the fabric is intended to be later embedded.

Fabric heating element 100 shown in FIG. 1 may be manufactured in various configurations to be inserted in various applications (e.g. heated clothing, car seats, etc.). Shown in FIG. 2 are top views of two examples of the manufactured fabric heating element 100 in FIG. 1.

In one example, fabric heating element 200 includes a non-perforated fabric layer 206, and busbars 204 and 208. In another example, fabric heating element 202 includes a perforated fabric layer 212, and busbars 210 and 214. Although not shown, electrical wires are connected to the busbars to apply a voltage to the busbars and produce an electrical current flowing through the fabric layers 206 and 212 respectively.

Many factors may determine the amount of electrical current flowing through the fabric layers and therefore the amount of heat produced by the device. These factors include but are not limited to distance between busbars (e.g. closer busbars provide a lower resistance electrical path and therefore produce higher current/temperature), level of voltage applied to the busbars (e.g. higher voltage produces higher current/temperature), and density/shape of perforations (e.g. higher density of perforations results in lower resistance and therefore higher current/temperature).

Figure 2:
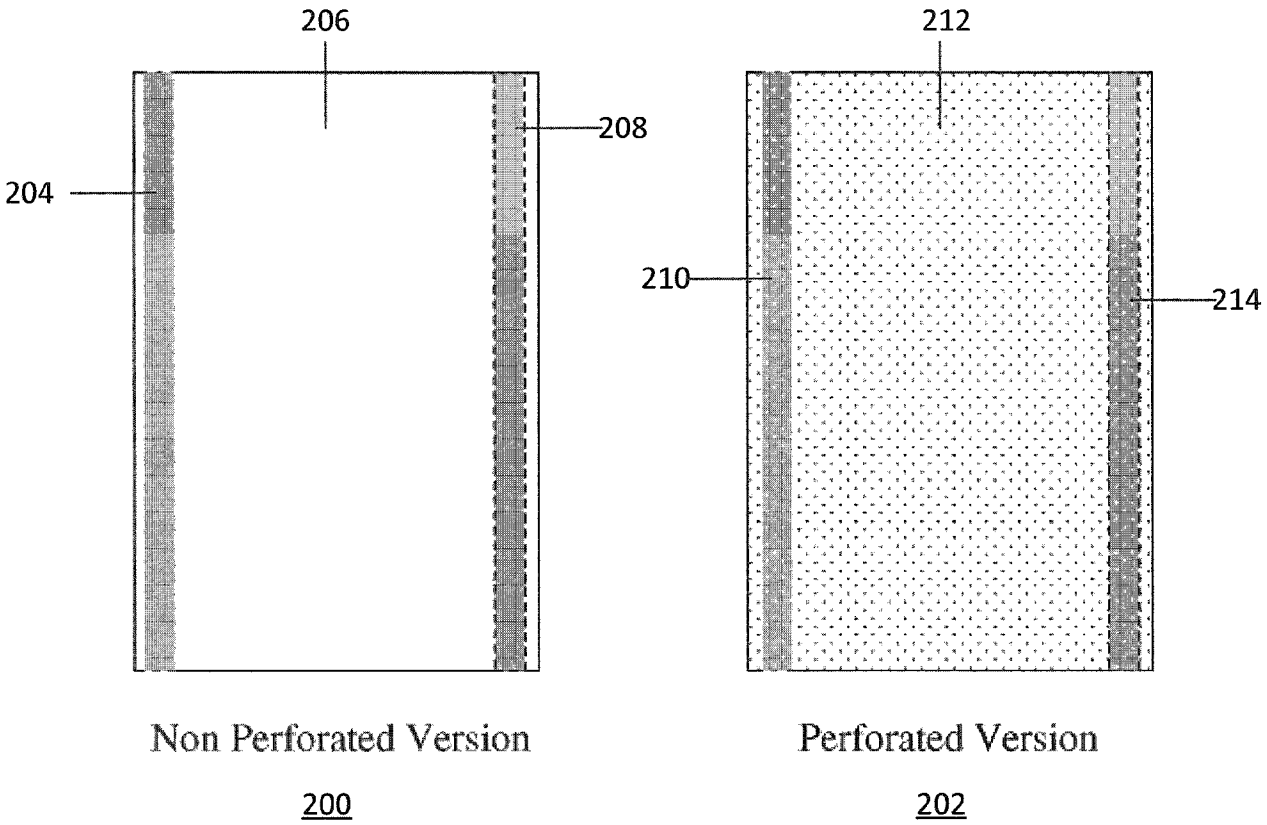
FIG. 2 is a top view of the fabric heating element with and without perforations, according to an embodiment of the present invention.
Figure 3:
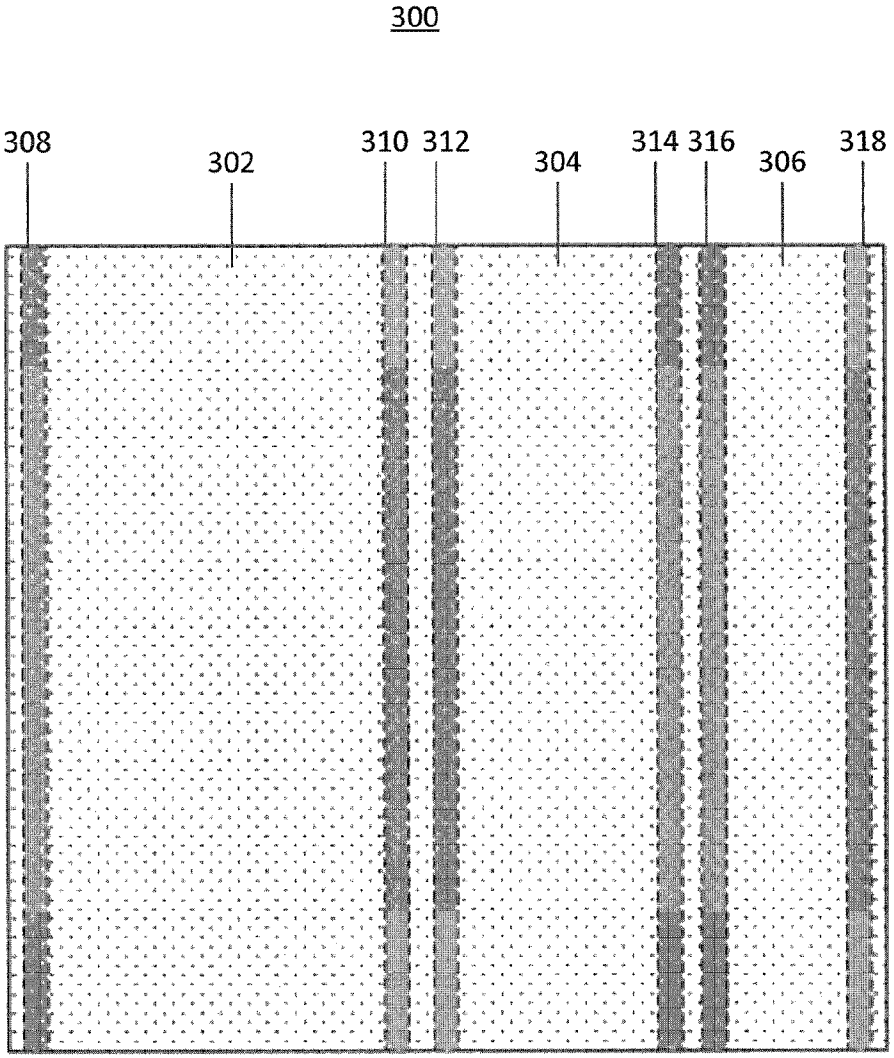
FIG. 3 is a top view of the fabric heating element with perforations and multiple busbar spacing distances, according to an embodiment of the present invention.

In addition to the dual busbar configurations shown in FIG. 2, the fabric heating element may be configured with more than two busbars as shown by the fabric heating element 300 in FIG. 3. By including more than two busbars, the device may have multiple independent heating areas that can be separately controlled. For example, as shown in FIG. 3, the fabric heating element includes three heating areas (e.g. 302, 304 and 306) produced by busbar pairs 308/310, 312/314 and 316/318 respectively.

In this example, each heating area may produce different amounts of heat for the same supply voltage due to the different spacing between the busbars (e.g. area 302 produces the least heat due to the large distance between busbars 308/310, whereas area 306 produces the most heat due to the small distance between busbars 316/318). Heat output may also be controlled independently using different supply voltages.

Figure 4:
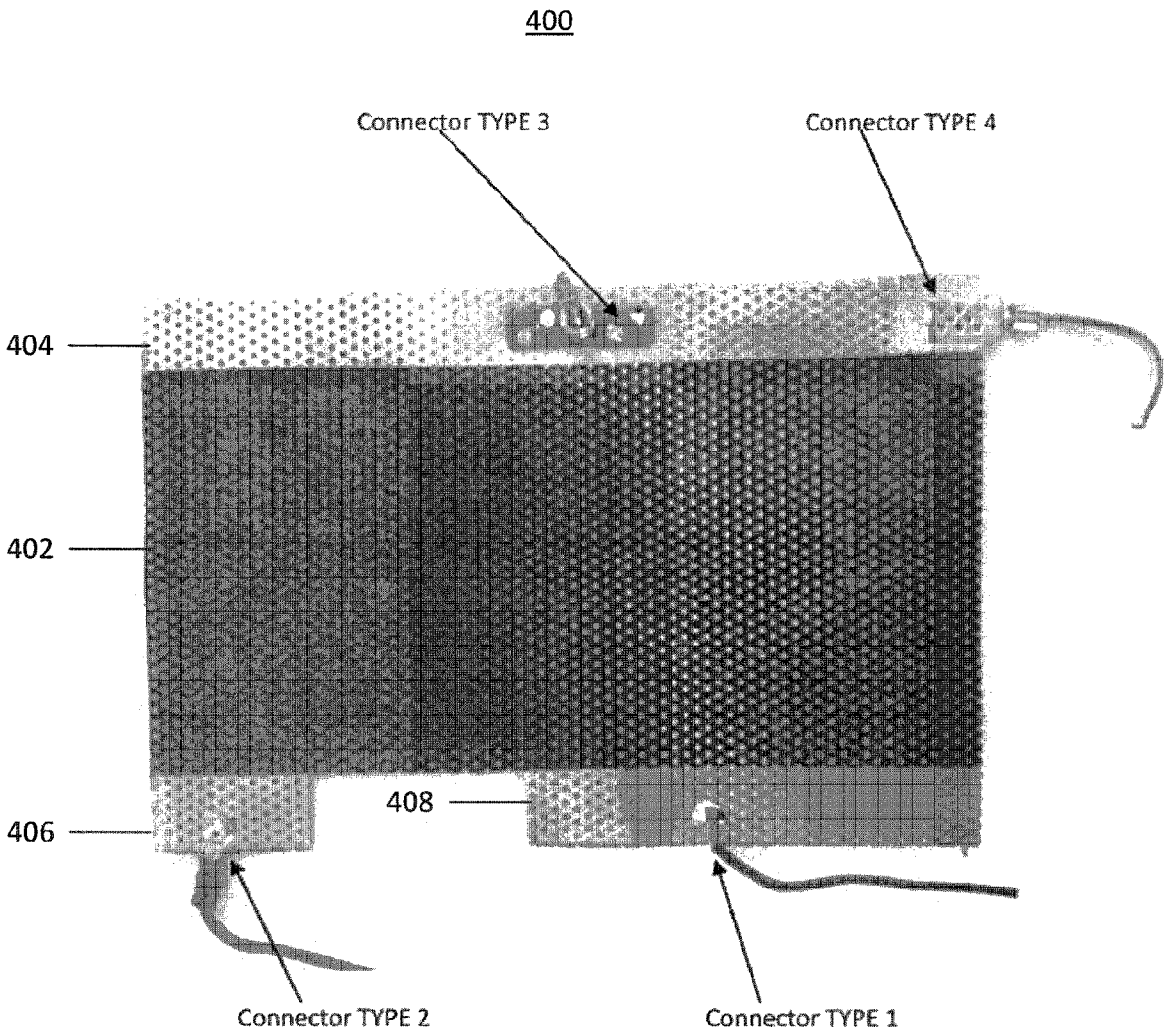
FIG. 4 is an image of the heating element with perforations and multiple types of electrical connectors, according to an embodiment of the present invention.

Electrical connections to the conductive strips shown in FIGS. 2 and 3 may include, but are not limited to: soldered wire, soldered inserts or fasteners, bolts or rivets, clamp connectors, and any other type of suitable connector. Additional information about and illustration of exemplary connections is shown in FIG. 4. In this example, each of the busbars includes a different type of mechanical connection to the electrical wire. For example, busbar 408 includes a type 1 connector (e.g. soldered wire connection which may be useful in heated blanket, mold heating and industrial heating applications), busbar 406 includes a type 2 connector (e.g. rivet or bolt using crimped wire eyelet which may be useful in heated tables and industrial heating applications), busbar 404 includes a type 3 connector (e.g. soldered fixed insert "big head fastener" which may be useful in mould heating, processing composite materials and integrated product heating applications) and a type 4 connector (e.g. quick clamp connector which may be useful for under floor heating applications).

Heating element 300 shown in FIG. 3 may be cut from a roll of material having busbars 308, 310, 312, 314, 316, and 318 that extend longitudinally along the entire roll. The resulting roll of material can then be used not only for creating heating elements that span the entire width of the roll, but also heating elements that span less than the entire width of the roll. For example, longitudinal cuts between busbars 310 and 312 and/or between busbars 314 and 316 permit construction of multiple heating elements, each of different widths, from the same roll of material. Other embodiments of rolls or sheets may have multiple pairs of busbars that are equally spaced or only a single pair of busbars.

When embedded in composite materials, the connectors or fasteners shown in FIG. 4 may also have a protective plating or coating (e.g. an anodised coating for aluminum or zinc plating for steel). Brass fittings generally don't need any treatment. Additional discrete pieces of the insulation plies may be provided in the area of the connectors for further electrical insulation if the fabric heater is to be embedded in carbon fiber composite laminate materials or other electrical conductive materials.

Although the connections in FIG. 4 are illustrated on a PowerFilm™ heating element, comprising a carbon veil coated with a thermoplastic polymer, these types of connections are suitable for use with any type of heater element, including the uncoated carbon veil in an embodiment of the Power Fabric described herein. Coated carbon fiber veils, such as PowerFilm™ heating elements, have mechanical properties suitable for some heating applications in which the film may ultimately be intended for embedding in thermoset laminate materials or into other incompatible materials into which it is difficult to chemically bond or embed the film. An advantage of the composite heating fabric with an uncoated carbon veil as described herein, over the PowerFilm™ product, is that it is suitability for embedding in a wider variety of materials and greater flexibility than provided by a thermoplastic coated carbon veil. PowerFilm heating elements or other coated carbon fiber veils may also be used in composite fabric embodiments.

Maximum temperature may be controlled using a Proportional Integral Derivative (PID) controller receiving feedback from a sensor in a closed loop system to control the set temperature or by applying the correct input voltage based on power input calculations for a given set temperature. Voltage input (e.g. AC/DC) supply voltage can be regulated and controlled using a voltage regulator connected to the voltage supply, or a smoothing capacitor on the input supply voltage.

Figure 5:
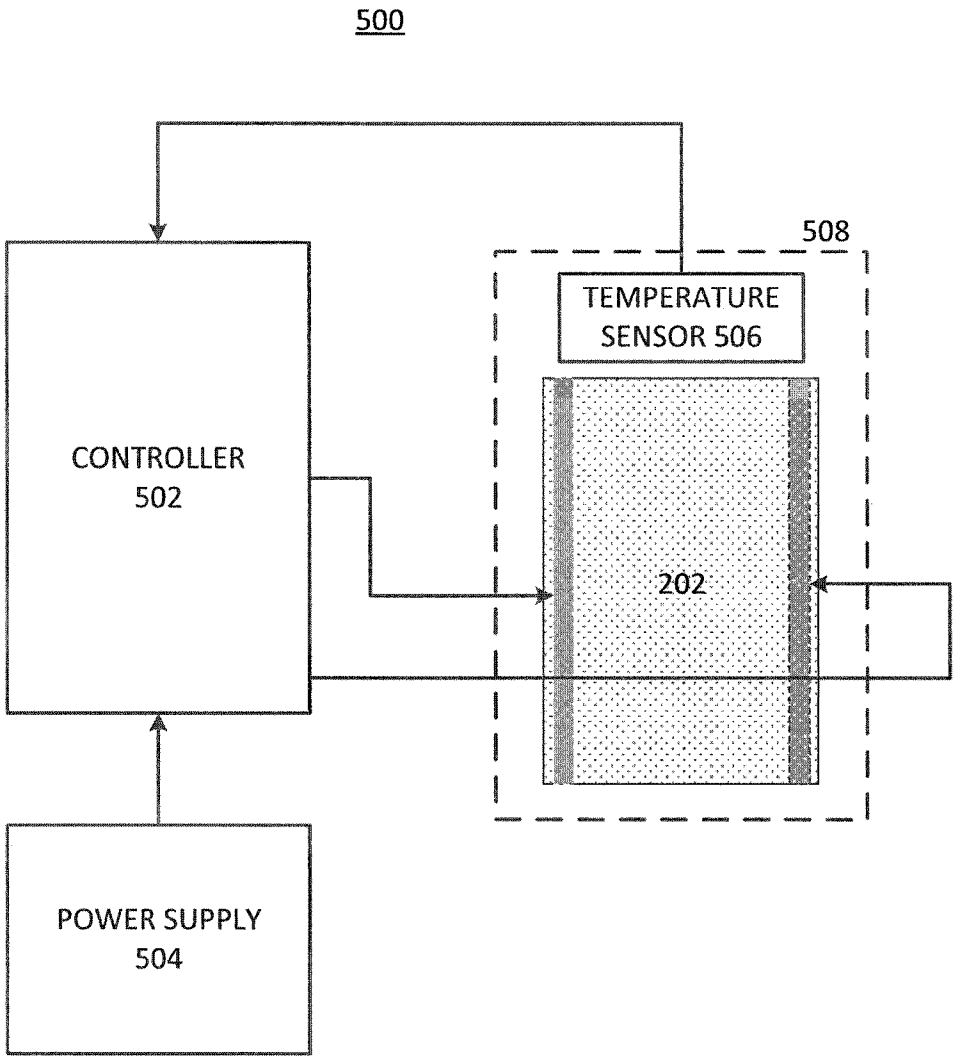
FIG. 5 is a block diagram of a heating system including the heating element and a controller, according to an embodiment of the present invention.

An example of a fabric layer heating system 500 including a controller is shown in FIG. 5. FIG. 5 shows a system with fabric layer element 202 and a temperature sensor 506 integrated in a device 508 (e.g. vehicle seat, clothing, etc.), and electrically coupled to controller 502 which receives and distributes power from power supply 504 to fabric layer element 202.

Figure 6:
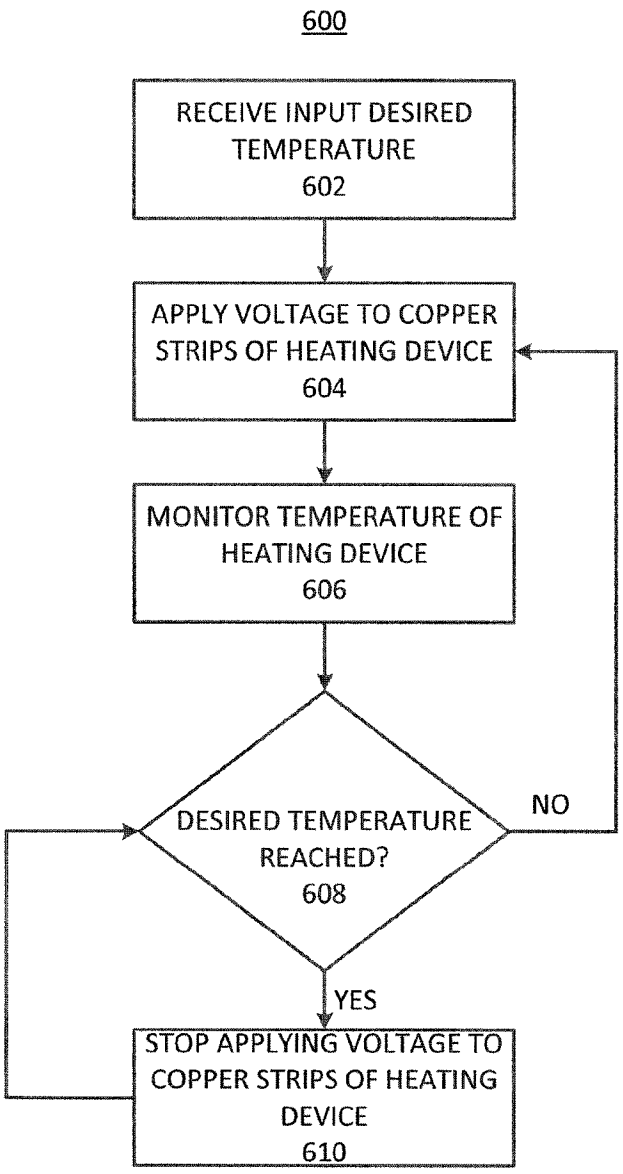
FIG. 6 is a flow chart describing an example operation of the heating system, according to an embodiment of the present invention.

The operation of fabric layer heating system 500, is described in the flowchart 600 of FIG. 6. In step 602, controller 502 receives an input from a user for setting a desired temperature (e.g. temperature of the vehicle seat). The input device is not shown in FIG. 5, but could include a dial, button, touchscreen, etc. In step 604, controller 502 applies a predetermined voltage to the busbars of fabric layer element 202 which then produces heat. In step 606, controller 502, uses temperature sensor 506 to monitor temperature of the fabric layer element 202. Temperature sensor 506 may be in direct contact, or in close proximity to fabric layer element 202. In step 608, controller 502 determines if the desired temperature has been reached. If the desired temperature has been reached, then in step 610, the controller 502 stops applying voltage to the busbars. If, however, the desired temperature is not reached, controller 502 continues to apply the voltage to the busbars.

Within the commercial constraints of the wet laid process for manufacturing non-woven web, use of short carbon fibers (e.g. fibers of 5 to 20 microns in diameter and between 3 and 9 mm average fiber length) may be desirable to achieve a uniform sheet having desirable uniform heat dispersion properties. When fiber length exceeds 9 mm, it may become technically difficult to manufacture the electrically conductive sheet containing uniformly dispersed carbon fiber throughout, with the result that irregularity in the resistance value from point to point in the sheet may become prohibitive.

Also, a dense network of short fibers causes the non-woven web to be relatively insensitive to holes or localised damage. The outer insulating and reinforcing layers and connecting adhesive layers of the heater element allow the use of the optimum fiber length in the non-woven web to provide uniformity of electrical resistance throughout the conducting non-woven layer. Weight of the outer layers typically varies between 20-100 grams/m2.

Also, the outer layers can be compatible with the materials into which they are embedded, by having coated or impregnated reinforcing layers that match or otherwise favourably pair chemically to the material in which they are embedded. For example, outer layers comprising a woven glass coated Polyvinyl chloride (PVC) may be used in a heating element to be embedded in a PVC floor covering for a heated floor application, and woven nylon/acrylic fabric outer layers may be used for producing heated clothing.

In applications where the heater element is embedded in viscous materials, like rubber or concrete, it may be desirable to perforate the heater element material such that an additional mechanical bond is achieved. Since the non-woven web is insensitive to holes, the ability to include such perforations to provide mechanical bonding is an added advantage over other state of the art heaters. The electrical resistance of the perforated heater increases typically by 35-50% due to the reduced area. In some applications, an open area of 18-20% may give optimum heater performance. An exemplary hole pattern may comprise, for example, 1.5 mm diameter holes spaced 3.5 mm on center.

The adhesive layers connecting the outer plies to the inner conducting layer are typically applied at 15-20 g/m2, and may comprise any compatible thermoplastic or thermoset web adhesive, such as PET, Thermoplastic polyurethane (TPU), Ethylene-vinyl acetate (EVA), polyimide, polyolefin, epoxy, polyimide, etc. The heater hybrid construction material may be manufactured on a commercial basis on state of the art low pressure/temp continuous belt presses. Typical machine production speeds of 10 mts/min are achievable.

The copper busbar strips and bonded to the non-woven inner conductive layer such that full electrical continuity is achieved throughout the heater material. The copper busbar strips may be bonded to the inner conductive layer at the same time as the entire heating fabric is consolidated, or prior to consolidation with the other layers. In a typical bonding process, the inner conductive layer and copper busbar strips (with sufficient adhesive between them) alone, or together with the other layers as described herein, may be fed into a laminating machine, such as a laminating belt press.

Figure 7:
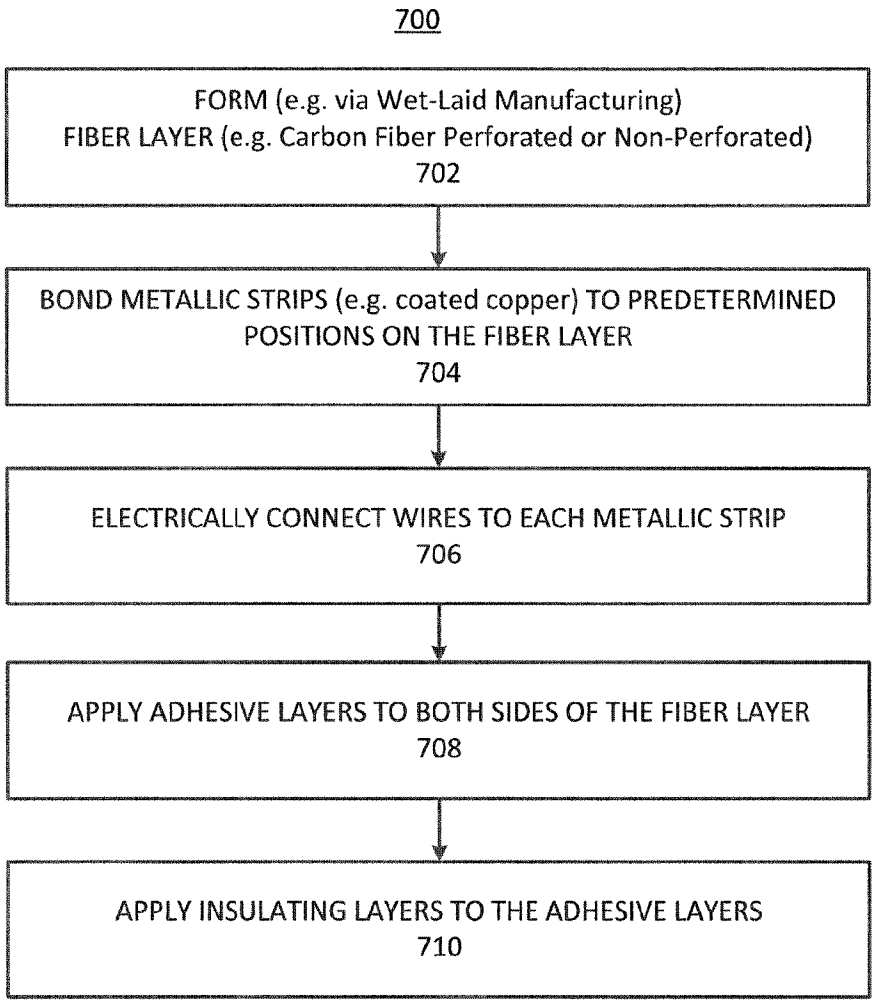
FIG. 7 is a flow chart describing an example method for manufacturing the heating device, according to an embodiment of the present invention.

A general example of the manufacturing process for the fabric heating element is described in flowchart 700 of FIG. 7. In step 702, for example, the manufacturer forms (e.g. via Wet-Laid Manufacturing) the fiber layer (e.g. Carbon Fiber either Perforated or Non-Perforated). In step 704, the manufacturer bonds metallic strips (e.g. Coated copper) to predetermined positions (e.g. specific distances from each other) on the formed fiber layer. In step 706, the manufacturer connects electrical wires to each of the metallic strips which allow application of the supply voltage. In step 708, the manufacturer applies adhesive layers to both sides of the fiber layer. Then, in step 710, the manufacturer applies insulating layers to both adhesive layers. In general, this manufacturing process produces the fabric heating element 100 shown in FIG. 1.

It should be understood that the invention is not limited to any particular materials of construction nor to any particular structural or performance characteristics of such materials, but that certain materials and structural performance characteristics may provide advantages, as set forth herein, and thus may be used in certain embodiments. Furthermore, it should be understood that the invention is not limited to any particular combination of components, and that each of the components as described herein may be used in any combination with any other components described herein.

In addition, although the invention is illustrated and described herein with reference to specific embodiments, the invention is not intended to be limited to the details shown. Rather various modifications may be made in the details within the scope and range of equivalence of the claims and without departing from the invention.

The invention claimed is:

1. A fabric heating element comprising:

an electrically conductive, non-woven fiber layer comprising a wet-laid layer comprising a plurality of individual unentangled fibers in an absence of conductive particles, the plurality of fibers having an average length of less than 12 mm and consisting of conductive fibers or a combination of conductive fibers and non-conductive glass fibers; and at least two conductive strips electrically connected to the fiber layer over a predetermined length, positioned adjacent opposite ends of the fiber layer, and configured to be electrically connected to a power source.

2. The fabric heating element of claim 1, wherein the fiber layer further comprises one or more binder polymers and a fire retardant.

3. The fabric heating element of claim 2,
wherein the fiber layer consists of the combination of the plurality of conductive carbon fibers and the plurality of non-conductive fibers, a binder, and one or more fire retardants.

4. The fabric heating element of claim 1, wherein the plurality of conductive fibers comprise carbon fibers.

5. The fabric heating element of claim 1, wherein the fiber layer has a uniform electrical resistance in any direction.

6. The fabric heating element of claim 1,
wherein each of the conductive fibers has a length in the range of 6-12 mm.

7. The fabric heating element of claim 6,
wherein each of the non-conductive fibers has a length in the range of 6-12 mm.

8. The fabric heating element of claim 1,
wherein one or more of the plurality of conductive fibers comprises a non-metallic fiber having a metallic coating.

9. The fabric heating element of claim 1,
wherein the fiber layer includes a plurality of perforations that increases the electrical resistance in a perforated portion of the fiber layer relative to resistance in the absence of perforations.

10. The fabric heating element of claim 9, wherein the perforations define an open area in the fiber layer in a range of 18-20%.

11. The fabric heating element of claim 9, wherein the plurality of perforations consists of a pattern of holes having a diameter D1 spaced on center at a distance D2.

12. The fabric heating element of claim 11, wherein D1=1.5 mm and D2=3.5 mm.

13. The fabric heating element of claim 1,
wherein the at least two conductive strips are copper.

14. The fabric heating element of claim 1,
wherein the predetermined length is an entire length or width of the fiber layer.

15. The fabric heating element of claim 1, further comprising:
at least one more conductive strip connected over another predetermined length of the fiber layer in between the at least two conductive strips.

16. A fabric heating element comprising:
an electrically conductive, non-woven fiber laver comprising a wet-laid laver comprising a plurality of individual unentangled fibers in an absence of conductive particles, the plurality of fibers having an average length of less than 12 mm and consisting of conductive fibers or a combination of conductive fibers and non-conductive glass fibers; and
at least two conductive strips electrically connected to the fiber layer over a predetermined length, positioned adjacent opposite ends of the fiber layer, and configured to be electrically connected to a power source;
at least one more conductive strip connected over another predetermined length of the fiber laver in between the at least two conductive strips;
wherein one of the at least two conductive strips and the at least one more conductive strip are spaced apart on the fiber layer at a first width, and
wherein another one of the at least two conductive strips and the at least one more conductive strip are spaced apart on the fiber layer at a second width different than the first width.

17. A fabric heating device, comprising:
a fabric heating element, the fabric heating element comprising:
an electrically conductive, non-woven fiber layer comprising a wet-laid layer comprising a plurality of individual unentangled fibers in an absence of conductive particles, the plurality of fibers having an average length of less than 12 mm and consisting of conductive fibers or a combination of conductive fibers and non-conductive glass fibers; and
at least two conductive strips electrically connected to the fiber layer over a predetermined length, positioned adjacent opposite ends of the fiber layer, and configured to be electrically connected to a power source;
a first adhesive layer adhered to a first side of the fiber layer and a first insulating layer; and
a second adhesive layer adhered to a second side of the fiber layer and a second insulating layer.

18. The fabric heating device of claim 17, wherein each of the at least two conductive strips includes an electrical connection to a power supply.

19. A fabric heating system comprising a fabric heating device, a controller, and a power supply:
the fabric heating device comprising a fabric heating element, a first adhesive layer, and a second adhesive layer,
the fabric heating element comprising:
an electrically conductive, non-woven fiber layer comprising a wet-laid layer comprising a plurality of individual unentangled fibers in an absence of conductive particles, the plurality of fibers having an average length of less than 12 mm and consisting of conductive fibers or a combination of conductive fibers and non-conductive glass fibers; and
at least two conductive strips electrically connected to the fiber layer over a predetermined length, positioned adjacent opposite ends of the fiber layer, and configured to be electrically connected to the power supply;
the first adhesive layer adhered to a first side of the fiber layer and a first insulating layer;
the second adhesive layer adhered to a second side of the fiber layer and a second insulating layer; and
the controller electrically connected to the power supply and the at least two conductive strips, the controller configured to apply a voltage from the power supply to the at least two conductive strips.

20. The fabric heating system of claim 19, further comprising:
a temperature inputting device for setting a desired amount of heat to be produced by the fabric heating device; and
a temperature sensor for detecting the heat produced by the fiber layer in response to an input from the temperature inputting device, and transmitting a signal to the controller indicating the amount of detected heat.

21. The fabric heating system of claim 19,
wherein the fabric element comprises at least three conductive strips, and each conductive strip is electrically connected to the power supply, and
wherein the controller s further configured to apply a first voltage to a first portion of the fiber layer between a first conductive strip and a second conductive strip, and apply a second voltage to a second portion of the fiber layer between a third conductive strip and the second conductive strip.

22. The fabric heating system of claim 19,
wherein the controller is configured to vary the voltage applied to the conductive strips to produce a predetermined amount of heat via the fiber layer.

23. The fabric heating system of claim 19, wherein the fabric heating system comprises a component of at least one of: upholstery of a vehicle, clothing, and a floor covering.

24. The fabric heating system of claim 19, wherein:

the fabric heating device is mounted in a seat of a vehicle, the power supply is a battery of the vehicle, and the controller Is a controller of the vehicle.

25. The A fabric heating element comprising:

an electrically conductive, non-woven fiber laver comprising a wet-laid laver comprising a plurality of individual unentangled fibers in an absence of conductive particles, the plurality of fibers having an average length of less than 12 mm and consisting of conductive fibers or a combination of conductive fibers and non-conductive glass fibers; and at least two conductive strips electrically connected to the fiber layer over a predetermined length, positioned adjacent opposite ends of the fiber layer, and configured to be electrically connected to a power source, wherein the fiber layer includes a plurality of perforations that increases the electrical resistance in a perforated portion of the fiber laver relative to resistance in the absence of perforations; and wherein the fiber layer and the at least two conductive strips comprise an inner layer disposed between a first outer laver and a second outer layers with adhesive disposed between a first side of the inner layer and the first outer layer, between a second side of the inner layer and the second outer layer, and extending through the perforations in the inner layer.

26. A fabric heating element comprising:

an electrically conductive, non-woven fiber layer comprising a wet-laid laver comprising a plurality of individual unentangled fibers in an absence of conductive particles, the plurality of fibers having an average length of less than 12 mm and consisting of conductive fibers or a combination of conductive fibers and non-conductive glass fibers; and at least two conductive strips electrically connected to the fiber layer over a predetermined length, positioned adjacent opposite ends of the fiber layer, and configured to be electrically connected to a power source;

a plurality of perforations in the fiber layer that increase the electrical resistance in a perforated portion of the fiber layer relative to resistance in the absence of perforations, wherein the fabric heating element is embedded in a viscous material, and the viscous material in combination with the perforations provides a mechanical bond.

27. A fabric heating element comprising:

an electrically conductive, non-woven fiber layer;

at least two conductive strips electrically connected to the fiber layer over a predetermined length, the at least two conductive strips positioned adjacent opposite ends of the fiber layer and configured to be electrically connected to a power source; and a plurality of perforations in the fiber layer that increases the electrical resistance in a perforated portion of the fiber layer relative to resistance in the absence of perforations and that defines a pattern that extends through the at least two conductive strips connected to the fiber layer.

28. The fabric heating element of claim 27, wherein the fiber layer and the at least two conductive strips comprise an inner layer disposed between a first outer layer and a second outer layer, and the heating element is a component of a composite structure, wherein material from the composite structure penetrates the plurality of perforations.

29. The fabric heating element of claim 28, wherein the composite structure is a floor covering.

30. The fabric heating element of claim 29, wherein the first outer layer and the second outer layer each comprise woven glass coated PVC, and the floor covering comprises PVC.

31. The fabric heating element of claim 27, wherein the fiber layer comprises a wet-laid layer of individual unentangled conductive fibers.

32. The fabric heating element of claim 31, wherein the fiber layer has no conductive particles.

33. The fabric heating element of claim 32, wherein the plurality of fibers have an average length of less than 12 mm.

34. The fabric heating element of claim 31, wherein the plurality of fibers have an average length of less than 12 mm.

35. The fabric heating element of claim 34, wherein the plurality of fibers consists of conductive fibers or a combination of conductive fibers and non-conductive glass fibers.

36. The fabric heating element of claim 31, wherein the plurality of fibers consists of conductive fibers or a combination of conductive fibers and non-conductive glass fibers.

37. The fabric heating element of claim 36, wherein the fiber layer has no conductive particles.

38. The fabric heating element of claim 36, wherein the plurality of fibers have an average length of less than 12 mm.

39. The fabric heating element of claim 27, wherein the plurality of perforations have a density and shape that affect electrical resistance in the perforated portion.

40. The fabric heating element of claim 27, wherein the heating element is sufficiently flexible to permit draping or formation into a 3D shape.

41. The fabric heating element of claim 1, wherein the fabric heating element is configured to be embedded into a material, and the fiber layer is infused or impregnated with the material.

42. The fabric heating element of claim 1, wherein all of the plurality of fibers have a length of less than 12 mm.

43. The fabric heating element of claim 42, wherein all of the plurality of fibers have a length in a range of 6 mm to 12 mm.

* * * * *